United States Patent [19]

Waters

[11] 4,373,583

[45] Feb. 15, 1983

[54] TEST-SYSTEM

[75] Inventor: Fleming A. Waters, Odessa, Tex.

[73] Assignee: Otis Engineering Corporation, Dallas, Tex.

[21] Appl. No.: 337,098

[22] Filed: Jan. 5, 1982

[51] Int. Cl.[3] ..... E21B 34/14

[52] U.S. Cl. ..... 166/113; 166/332; 166/334

[58] Field of Search ..... 166/113, 317, 319, 325, 166/332, 333, 334, 322

[56] References Cited

U.S. PATENT DOCUMENTS

| | | | |
|---|---|---|---|
| 3,051,243 | 8/1962 | Grimmer et al. | 166/332 |
| 3,335,802 | 8/1967 | Seyffert | 166/334 |
| 3,422,896 | 1/1969 | Nutter | 166/113 |
| 3,747,682 | 7/1973 | Taylor | 166/322 |
| 4,069,865 | 1/1978 | Gazda et al. | 166/113 |

*Primary Examiner*—Ernest R. Purser
*Assistant Examiner*—Thuy M. Bui
*Attorney, Agent, or Firm*—Vinson & Elkins

[57] ABSTRACT

A test system for wells which may be utilized in any well having a landing nipple therein. A pressure recording instrument is run in on a locking mandrel and a closing tool is provided which cooperates with a valve and moves it from open to closed position. With the closing prong engaged with the valve member and the valve in open position a small diameter extension on the prong is positioned opposite the ports in the valve to provide a large flow area.

3 Claims, 7 Drawing Figures

TEST-SYSTEM

This invention relates to test systems for wells and more particularly to a test system which may be used in any existing well which includes a landing nipple in the tubing adjacent the producing formation.

In the testing of wells it is desirable to be able to flow the well at a high rate of flow until the pressure in the well at the formation face stabilizes. Thereafter, the well is desirably shut-in and the gradual built up in pressure recorded until the well again stabilizes. As inaccuracies result when the measurements are made at the surface, the pressure measurement should be made adjacent the producing formation.

To obtain the desired large flow rates which open formations are capable of producing, the equipment should be such that the flow way is restricted as little as possible.

Where wells are completed with the testing in mind, provision may be made for substantially unrestricted flow and down hole pressure measurement. Where wells are not completed with testing facilities, the entire test package must be run in and landed in a landing nipple. Known procedures for testing where the package is landed in a nipple in the tubing have positioned the recording instrument above the valve controlling flow through the tubing during the test. Positioning the pressure recording instrument above the control valve reduces the flow area for producing the well at high rates, and it would be advantageous to have a well test system usable in wells having the system supported in a landing nipple in the tubing and presenting a minimum obstruction to flow of well fluids in the tubing.

U.S. Pat. Nos. 3,102,593; 4,069,865; 4,149,593; 4,051,899; 4,134,452; 4,159,643; 4,266,614; 4,274,485; and 4,289,201 illustrate various systems for obtaining the pressure build up curve in a well. U.S. Pat. No. 4,159,643 illustrates a system which may be utilized after a well has been completed positioning the recording instrument above the valve controlling flow.

It is an object of this invention to provide a test system for wells which may be utilized in existing wells not specially completed for testing and in which the well may be flowed at a high production rate and then shut-in for pressure build up measurements at a location adjacent the producing formation.

Another object is to provide a well test system as in the preceding object in which the pressure measuring instrument is below the valve controlling flow through the tubing.

Another object is to provide a well test system which may utilize standard locking mandrels and pressure relief valves and which is very simple and rugged in construction.

Another object is to provide a well test system in which a valve and pressure recording instrument may be landed in the lower end of a tubing and in which the recording instrument is positioned below the valve so that only a single set of flow ports are required to provide for a high rate of flow through the system, thus eliminating the necessity for additional ports and seals to conduct pressure fluid to a recording instrument above the valve after the valve has been closed.

Other objects, features and advantages of the invention will be apparent from the drawings, the specification, and the claims.

In the drawings wherein an illustrative embodiment of this invention is shown and wherein like reference numerals indicate like parts:

Figures 1, 2, 3:
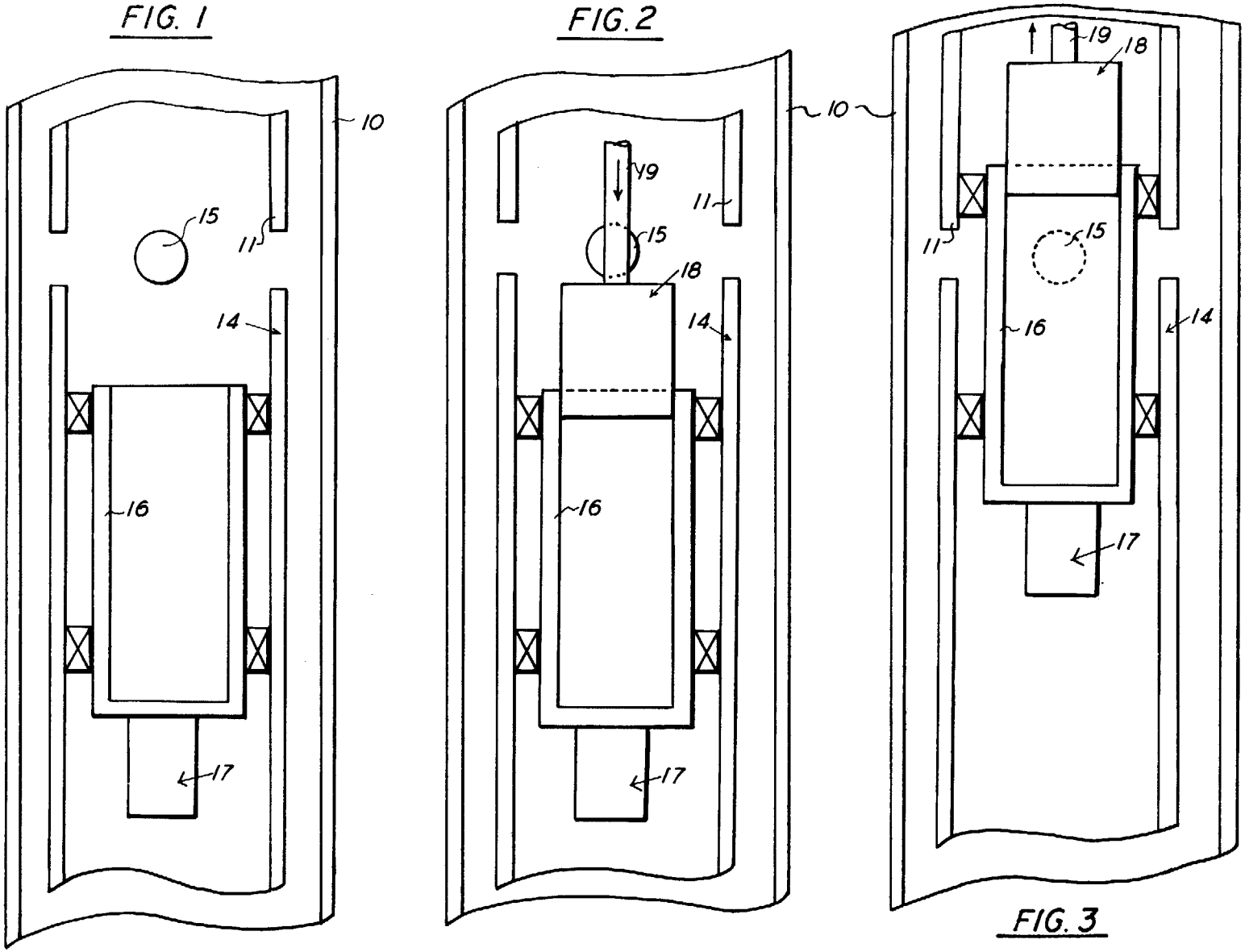
FIG. 1 is a schematic illustration of the flow control valve landed in a landing nipple in the well and in open position.
FIG. 2 is a view similar to FIG. 1 showing the closing tool to be latched into the control valve with the valve remaining open.
Figure 4A:
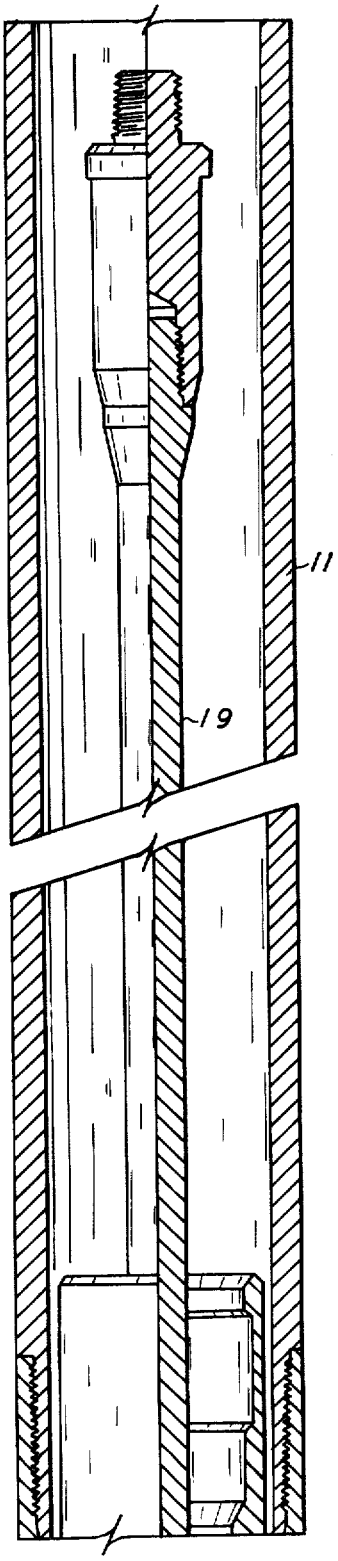
Figure 4B:
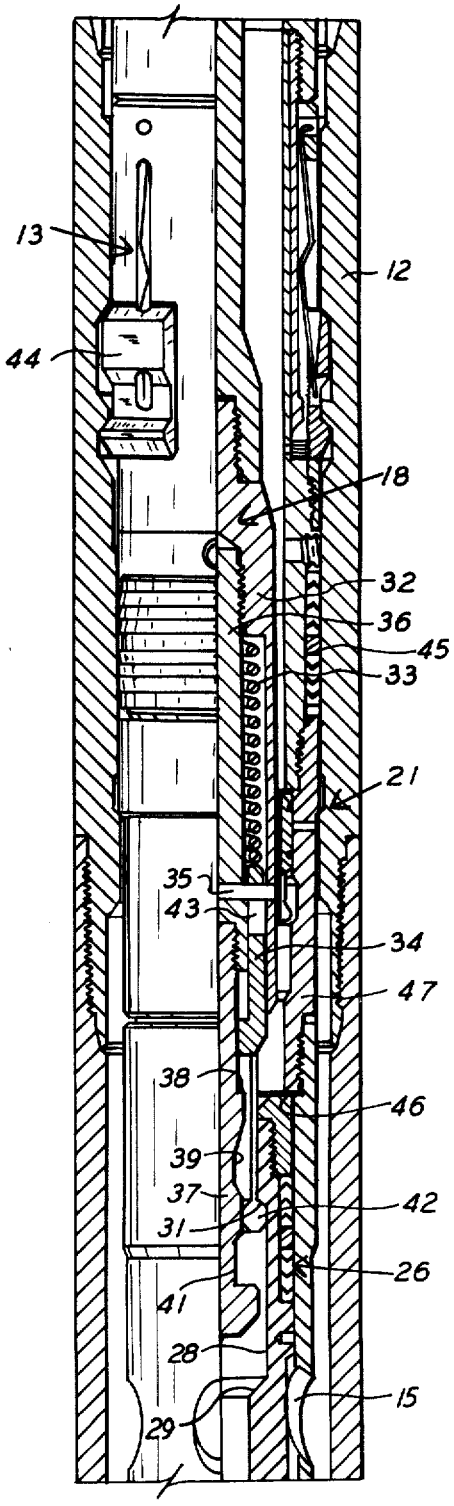
Figure 4D:
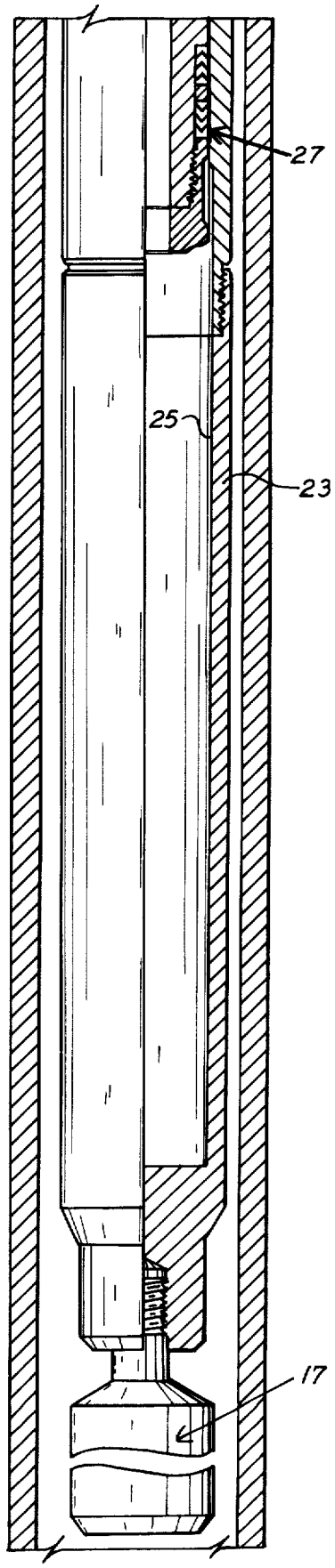
Figure 4C:
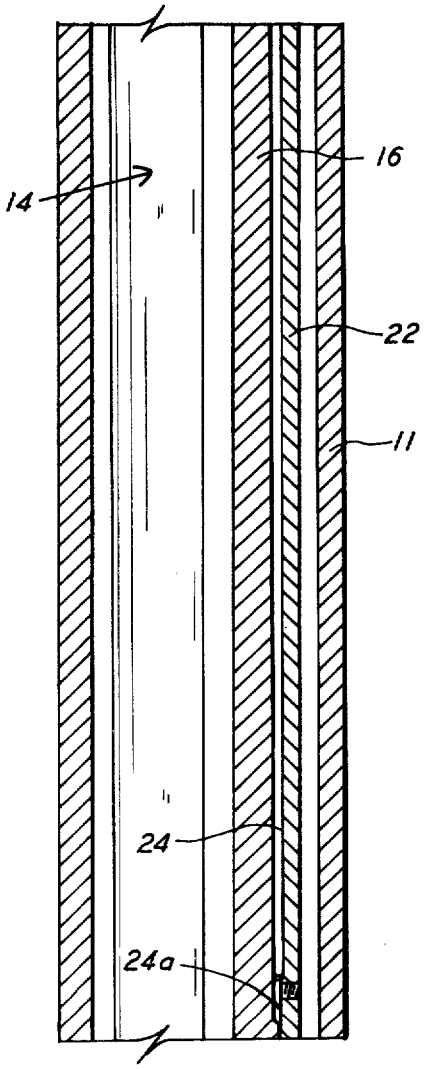

FIG. 3 is a view similar to FIG. 2 in which the control valve has been closed; and FIGS. 4A, 4B, 4C and 4D are continuation views illustrating a tubing including a landing nipple in longitudinal section having therein a locking mandrel, pressure relief valve and a flow valve shown in quarter-section, with a pressure recording instrument shown in elevation on the lower end thereof, and a closing tool shown in quarter-section latched to the flow valve.

Referring first to FIG. 1, a well including casing 10 has positioned therein, a tubing 11. Positioned in the tubing is a flow control valve indicated generally at 14 having a plurality of large ports 15, through which the well may be flowed at a high rate to determine the flow capacity of the formation. These ports 15 are controlled by a valve member such as the slide valve 16 shown in open position below the ports. Other types of valve may be utilized but a slide valve is preferred.

Below the control valve 14 the pressure recording instrument indicated generally at 17 is depended from the assembly. The pressure recording instrument may take any desired form which will continuously measure and record pressure in the tubing at the location of the instrument.

Referring to FIG. 2, the control valve 14 has latched therein a closing tool indicated generally at 18. This tool may take any desired form and be latched to the control valve in any desired manner. The design of the closing prong and of the valve should be such that the entire mechanism of the prong will be located below the ports 15 as shown in FIG. 2 to permit the closing prong to be latched in place with the slide valve 16 in open position and only a smaller diameter extension 19 extending upwardly from the closing probe and located in the area of the flow ports 15. This small diameter extension 19 may be dimensioned so as not to restrict flow through the ports 15 and the locking mandrel thereabove.

The valve 14 and closing prong 18 are designed so that with the valve member 16 in a full open position only the extension 19 is located in the area of the flow ports 15. Where a slide valve 16 is utilized and where the closing prong 18 extends above the upper end of the slide valve, the design should permit the slide valve 16 to move downwardly a substantial distance to position the closing prong 18 below the ports with only the extension in the area of the ports.

Referring to FIG. 3 the system is shown after the well has been flowed through the open valve to determine the formation flow rate and the closing probe raised to move the valve member 16 to closed position. With the test apparatus in this condition, the pressure bomb 17 may record the pressure in the tubing adjacent to the formation as the pressure in the tubing builds up to full formation pressure to thus provide a pressure build up curve.

Referring to FIGS. 4A, 4B, 4C and 4D, the tubing 11 includes the landing nipple 12 in which there is shown to be landed a locking mandrel 13. Those illustrated are known as the XN lock mandrel and XN landing nipple available from Otis Engineering Corporation, Dallas, Texas. The landing nipple 12 may take any conventional form and will normally be run as a part of a conventional completion at a level close to the producing formation to provide for landing tools of many different types at this level in the tubing. Thus, the system may be run in a well which was completed without special equipment for test procedures. The locking mandrel may take any conventional form and is run in the well and locked in the landing nipple utilizing conventional procedures.

Below the locking mandrel the flow control valve is indicated generally at 14 and includes the ports 15 controlled by the valve member 16.

Suspended from the valve 14 is the pressure recording device such as that known as an Amerada Bottom Hole Pressure Gauge.

Latched to the valve member 16 of the control valve 14 is the closing tool indicated generally at 18 having the small diameter extension 19 thereabove.

After the pressure build up curve has been obtained, a substantial differential will be present across the valve 14. To relieve this differential a pressure relief valve indicated generally at 21 is provided which is conventional in form to relieve this differential in pressure and facilitate removal of the lock mandrel and its depending valve and recording device. The equalizing valve shown is known as an XO equalizing valve and is available from Otis Engineering Corporation, Dallas, Texas. The valve is automatically opened by the pulling tool which is utilized to pull the lock mandrel from the well.

The valve 14 includes a valve body made up of the upper barrel 22 and the lower barrel 23. The upper barrel 22 of the body has a relatively large diameter bore 24 throughout most of its length and a relatively smaller diameter bore **24*a*** at its lower end.

The valve member 16 is provided with an upper seal indicated generally at 26 and a lower seal indicated generally at 27. The upper seal 26 cooperates with the large diameter bore 24 through the body and the lower seal 27 cooperates with the smaller diameter bore **24*a* in the body. The difference in diameters of the seals 26 and 27 results in a pressure responsive area subject to well pressure below the valve acting in an upwardly direction. This area of course is exposed to pressure within the tubing above the test apparatus. As the formation well pressure will be greater than the pressure within the tubing above the apparatus, the differential in area will exert a force tending to maintain the valve 14 in closed position once it has been closed. Prior to closing of the valve the pressure above and below the valve will be substantially equal and this differential in area ineffective. Also, the bore 25 below the small diameter bore 24*a* is slightly larger than seal 27 so that the seal is ineffective until it engages bore 24*a***.

At the upper end of the valve there is provided an internal groove 28 resulting in an upwardly facing shoulder 29 against which the closing tool 18 may bottom as the closing tool is run into the valve and a downwardly facing shoulder 31 for engagement by the closing tool. In many instances the bore diameter through the locking mandrel may be limited and it is preferred to have the engaging shoulder 31 at the upper end of the valve member permitting a substantial portion of the closing tool to be larger in diameter than the shoulder 31 and thus positioned above the valve member when latched thereto. In order to position the closing tool below the flow ports 15 with the valve in open position, the valve body and the valve member have substantial length dimensions so that the valve member 16 may move downwardly a sufficient distance to position all of the closing tool below the ports 15 with the exception of the extension 19.

The closing tool 18 includes a spring housing 32 having spring 33 therein. The spring 33 urges the collected shear sleeve 34 downwardly against the shear pin 35 which maintains the sleeve 34 in up position and the spring 33 in compression.

Within the spring housing 32 there is provided an upper core 36 which supports the shear pin 35. Depending from the upper core 36 is a lower core 37 having a plurality of external grooves thereon to cooperate with the colleted shear sleeve 34. The uppermost groove provides a shoulder 38 against which the colleted shear sleeve 34 may abut after the shear pin 35 has been sheared. Immediately below this shoulder the groove 39 provides a recess in which the collets 42 which depend from the colleted shear sleeve 34 may be depressed as they move past the upper end of the valve member 16 to a point below the shoulder 31. A third groove 41 provides a second area into which the collets 42 may be depressed when the closing tool is released from the valve.

The colleted shear sleeve 34 has a vertical slot 43 therein into which the shear pin 35 extends. This slot permits the sleeve 34 to move upwardly relative to the lower core 37 to position the collets 42 opposite the groove 39. After the pin 35 has been sheared the collet sleeve moves downwardly into abutment with the shoulder 38 on the lower core positioning the collets 42 opposite the groove 41.

In operation of the test system, the locking mandrel 13 has the pressure relief valve 21 made up thereon and the flow control valve 14 depending from the pressure relief valve. The recording instrument 17 is depended from the control valve. This assembly is run into the well in the conventional manner and landed in the landing nipple 12 with the dogs 44 locking the locking mandrel in the landing nipple and the seal 45 on the locking mandrel sealing between the mandrel and the landing nipple 12. The system is normally run with the well shut-in at the surface and with the control valve in open position.

After the locking mandrel has been landed, as by conventional wireline procedures, the closing tool 18 is run on wireline and engaged with the valve member 16. As the collets 42 strike the upper end of the valve member, the spring 33 will be compressed and the collets will move into the groove 39 and be flexed inwardly to permit them to move past the shoulder 31 in the valve member. As they move past the shoulder, the spring 33 will again extend the sleeve 34 until the shear pin 35 is engaged and the parts are in the position shown in FIG. 4, except that the valve member and closing tool are in the lower position shown in FIG. 2 with only the extension 19 opposite the flow ports 15. The well is permitted to flow to determine the flow capabilities of the formation. After the desired data is obtained regarding flow rates, the closing tool 18 is moved upwardly to the position shown in FIGS. 3 and 4 to move the upper end of the valve member 16 into engagement with the shoulder 46 provided by the lower end of the pressure relief valve housing 47 to arrest upward movement of the valve member 16. At this time, the well is shut-in at the lower end of the tubing which is adjacent to the producing formation and the recording instrument 17 will begin measuring the increase in pressure in the well adjacent the producing formation to provide a pressure build up curve. At this time, the closing tool may be removed or the closing tool may be left in place until after the pressure build up curve measurements have been completed.

In removing the closing tool a strain is taken on the wireline sufficient to shear pins 35. When this occurs the spring 33 expands and drives the collets 42 to the area of the groove 41 in the lower core 37 permitting the collets to be retracted as they pass shoulder 31 and the closing tool to be removed from the well.

After the closing tool has been removed the lock mandrel and the depending valves and recording instruments may be retrieved from the well using conventional wireline procedures.

The foregoing disclosure and description of the invention is illustrative and explanatory thereof and various changes in size, shape and materials, as well as in the details of the illustrated construction may be made within the scope of the appended claims without departing from the spirit of the invention.

What is claimed is:

1. A test system for wells comprising, a landing nipple having locking grooves therein, a lock mandrel releasably locked in said landing nipple, a pressure relief valve carried by the lock mandrel, a valve suspended from the lock mandrel, said valve including a valve body having lateral ports at its upper end and a valve member movable between open and closed positions, a closing tool for engaging said valve member and moving it from open to closed position, means for releasing said closing tool from said valve member with said valve member in closed position, said closing tool having a small diameter extension at its upper end, said closing tool and the valve member dimensioned such that said closing tool extension is opposite said ports when said tool and valve member are engaged and said valve member is in its open position, and a pressure recording instrument suspended from the valve.

2. A test system for wells comprising, a landing nipple having grooves therein, a lock mandrel releasably locked in said landing nipple, a pressure relief valve carried by the lock mandrel, a slide valve suspended from the lock mandrel, said slide valve including a valve body having lateral ports at its upper end and a slide valve member movable downwardly a substantial distance below said ports, a closing tool for engaging said slide valve member and moving it upwardly from open to closed position, means for releasing said closing tool from said valve member with said slide valve member in closed position, said closing tool having a small diameter extension at its upper end, said closing tool and slide valve dimensioned such that said closing tool extension is opposite said ports when said tool and valve member are engaged and said valve member is in its lower position, and a pressure recording instrument suspended from the slide valve.

3. The test system of claim 2 wherein the slide valve member carries upper and lower seals straddling said ports with the upper seal having a larger pressure responsive surface than the lower seal which after the valve has been closed urges the valve member toward closed position in response to well pressure.

* * * * *